US010378156B2

(12) United States Patent
Górnioczek et al.

(10) Patent No.: US 10,378,156 B2
(45) Date of Patent: Aug. 13, 2019

(54) DEVICE FOR FASTENING TRACKSIDE MODULES TO RAILS

(71) Applicant: Bombardier Transportation (ZWUS) Polska Sp. z o. o., Katowice (PL)

(72) Inventors: Marek Górnioczek, Tarnowskie Gory (PL); Wojciech Radwanski, Katowice (PL); Adam Szczeponik, Chorzow (PL); Dariusz Zielinski, Jaworzno (PL); Mateusz Mazur, Dabrowa Gornicza (PL); Andrzej Stepien, Dabrowa Gornicza (PL); Aleksandra Sawodni, Bytom (PL)

(73) Assignee: Bombardier Transportation (ZWUS) Polska Sp. z o. o., Katowice (PL)

( * ) Notice: Subject to any disclaimer, the term of this patent is extended or adjusted under 35 U.S.C. 154(b) by 28 days.

(21) Appl. No.: 15/575,057

(22) PCT Filed: May 18, 2016

(86) PCT No.: PCT/EP2016/061129
§ 371 (c)(1),
(2) Date: Nov. 17, 2017

(87) PCT Pub. No.: WO2016/184908
PCT Pub. Date: Nov. 24, 2016

(65) Prior Publication Data

US 2018/0142425 A1 May 24, 2018

(30) Foreign Application Priority Data

May 18, 2015 (PL) ..... P.412382

(51) Int. Cl.
*E01B 9/32* (2006.01)
*B61L 1/02* (2006.01)
(Continued)

(52) U.S. Cl.
CPC ..... *E01B 9/32* (2013.01); *B61L 1/02* (2013.01); *B61L 1/16* (2013.01); *B61L 3/22* (2013.01);
(Continued)

(58) Field of Classification Search
CPC ..... B61L 1/02; B61L 1/16; B61L 3/22; B61L 3/126; B61L 26/00; E01B 9/32
See application file for complete search history.

(56) References Cited

U.S. PATENT DOCUMENTS 3,941,338 A * 3/1976 Knudsen ..... B61L 1/16 246/77
5,628,479 A * 5/1997 Ballinger ..... B61L 1/165 246/122 R
(Continued)

FOREIGN PATENT DOCUMENTS

AU 2006324346 A1 6/2007
CN 203996281 U 12/2014
(Continued)

OTHER PUBLICATIONS

Abstract of PL 101060U1; Published on Mar. 4, 1996; English-language Abstract included.

*Primary Examiner* — Jason C Smith
(74) *Attorney, Agent, or Firm* — The Webb Law Firm

(57) ABSTRACT

The invention relates to a device for fastening trackside modules to a rail having a base and a head. The device includes two clamps that are clamped on the base of the rail with the use of a mechanism that extends under the base of the rail. At least one of the clamps is movable. A bracket is fastened to at least one of the clamps and a trackside module is fastened next to the head of the rail. A pair of brackets is fastened with the use of fasteners to surfaces of each of the clamps. The brackets extend transversely to the longitudinal axis of the rail and at least one upwardly extending section is fastened using second fasteners to at least one of the
(Continued)

brackets outer side surfaces. At least one trackside module is fastened to an upper end region of at least one upwardly extending section.

16 Claims, 4 Drawing Sheets

(51) Int. Cl.

| | |
|---|---|
| ***B61L 1/16*** | (2006.01) |
| ***E01B 26/00*** | (2006.01) |
| ***B61L 3/22*** | (2006.01) |
| ***B61L 3/12*** | (2006.01) |

(52) U.S. Cl.
CPC ..... *E01B 26/00* (2013.01); *B61L 3/126* (2013.01); *B61L 2003/228* (2013.01)

(56) References Cited

U.S. PATENT DOCUMENTS

| | | | | |
|---|---|---|---|---|
| 7,216,558 | B2 * | 5/2007 | Kumar | B61L 1/02 73/866.5 |
| 8,752,797 | B2 * | 6/2014 | Carlson | B61L 1/164 246/122 R |
| 2007/0204705 | A1 * | 9/2007 | Kumar | H03M 7/30 73/866.5 |

FOREIGN PATENT DOCUMENTS

| | | | |
|---|---|---|---|
| DE | 974202 | C | 10/1960 |
| EP | 1960603 | B1 | 12/2009 |
| FR | 2350239 | A1 | 12/1977 |
| JP | 8119105 | A | 5/1996 |
| WO | 2007068009 | A1 | 6/2007 |

* cited by examiner

DEVICE FOR FASTENING TRACKSIDE MODULES TO RAILS

CROSS-REFERENCE TO RELATED APPLICATIONS

This application is the United States national phase of International Application No. PCT/EP2016/061129 filed May 18, 2016, and claims priority to Polish Patent Application No. P.412382 filed May 18, 2015, the disclosures of which are hereby incorporated in their entirety by reference.

BACKGROUND OF THE INVENTION

Field of the Invention

The invention relates to a device for fastening trackside modules, in particular to a running rail of a railway for rail vehicles. For example, the rail may be a grooved rail and/or a Vignole type rail). In particular the rail may be one of the two rails of a dual-rail railway for rail vehicles. In particular, one or more than one of the following devices are examples of trackside modules to be fastened to the rail: wheel and/or vehicle detectors, in particular wheel detector heads, current transformers and communication devices for communication between a vehicle travelling on the rail and the trackside.

Description of Related Art

It is necessary to fasten modules of systems (i.e. trackside modules) which in the course of a normal operation are located next to a head of a rail. Both at the stage of installation and of normal operation it is required to perform initial and periodical adjustment of the position of the trackside modules in relation to the head of a rail due to the diversity of types of rails used and the wear and tear of rails.

It is possible to use clamps that are mounted on to the base of a rail. Movable or fixed (immovable) sections are fastened to the mounted clamps. Movable sections enable a change of the position of trackside modules without the need to use adaptor plates.

Furthermore, grooves can be made in the surfaces that are connected. These grooves increase the immunity of screwed items to an undesired change of position during installation and during vibrations. Sections which are immovable (fixed) in relation to the clamps require adaptor plates or positioning nuts.

A solution is disclosed in U.S. Pat. No. 7,216,558 B according to which clamps are mounted on the base of a rail. The position of the clamp is adjusted by using adaptor plates and therefore additional parts need to be supplied to the customer throughout the life cycle of the product.

U.S. Pat. No. 3,941,338 discloses clamps that are fastened to the base of a rail. The position is set by using nuts which enable changing the position of a trackside module solely in parallel to Y axis (the horizontal axis transverse to the longitudinal Z axis of the rail).

A solution in which the clamps are fastened to a base of a rail and a bracket with a groove is parallel to the rail which enables changing the position of the trackside module in parallel to X axis (the vertical axis) is presented in DE 974202.

EP 1 960 603 A1 discloses a solution in which clamps are fastened to the base of a rail. One of the clamps consists of a support and two clamp parts which abut on opposite sides on the support. They are assembled in such a way that the upper surface of the support of the clamp contacts the lower surface of the base of the rail, whereas the inner surface of the clamp parts contacts the upper surface of the base of the rail. A change of position of the clamp parts (in the direction of or parallel to the Y axis) relative to the support causes a change of the depth to which the support is seated under the base of a rail which makes it possible to change the position of the trackside module in the direction of, or parallel to the Y axis. A girder is fastened to the external surface of the clamp (in the plane that is parallel to the plane of symmetry of the web of rail) in such a way that it makes it possible to change the position of the girder in such a manner that the trackside module could be positioned in parallel to the X axis. Like in the solutions referred to above, there are grooves in surfaces of these items which enable changing position in relation to one another.

SUMMARY OF THE INVENTION

It is an object of the invention to provide a device for fastening trackside modules to a rail (for example a grooved rail and/or a Vignole type rail) in order to enable a required mounting and/or operating position of the module(s) to be fastened.

A device is proposed for fastening trackside modules, such as, e.g. wheel detector heads, current transformers to a rail, wherein the device has two clamps that are clamped or are to be clamped on the base of the rail with the use of a screw mechanism that is located under the base of the rail. Both clamps are movable. A bracket (in particular a vertical bracket) is attached to at least one of the clamps and the trackside module is fastened to the end of the bracket which is located next to the head of the rail. Preferably, the device has two pairs of brackets that are fastened with the use of (in particular threaded) fasteners to the walls and/or surfaces of the clamps. In particular, each pair of brackets is fastened to one of the clamps. In addition or alternatively, a first of the pair of brackets is fastened to a first surface of the clamp and a second of the same pair of brackets is fastened to a second surface of the same clamp, wherein the first surface and the second surface are opposite to each other with respect to a central region of the clamp.

In particular, a device is proposed for fastening trackside modules, such as, e.g. wheel detector heads and/or current transformers, to a rail having a base and a head, wherein the device comprises two clamps that are to be clamped on the base of the rail with the use of a mechanism that extends under the base of the rail, wherein at least one of the clamps is movable, wherein a pair of brackets is fastened with the use of (in particular threaded) first fasteners to surfaces of each of the clamps, wherein the brackets extend transversely to the longitudinal axis of the rail and at least one upwardly extending section is fastened using (in particular threaded) second fasteners to one of or to each of the outer side surfaces of the brackets, wherein at least one trackside module is to be fastened to an upper end region of the upwardly extending section or to upper end regions of a plurality of the upwardly extending sections. Preferably, at least one upper end region of an upwardly extending section is adapted to be connected and thereby fastened to at least one trackside module, for example by threaded fasteners.

The fixation (fastening) by using at least one of the threaded fasteners mentioned in this description can be realised in connection with an oblong hole, so that it is possible to move and/or re-position a screw or stud bolt (i.e. the part comprising the external thread) within the oblong hole in a direction transverse to the longitudinal axis of the screw or stud bolt. By moving or re-positioning the screw or stud bolt in this manner, the relative position of the parts to be fixed to each other by the threaded fasteners is changed.

In particular, each of the clamps may produce the clamping force onto the lower and upper side surfaces of the base of the rail, which clamping force results in the fastening of the device to the rail. In this case, the brackets fastened to the clamps do not produce a clamping force of this kind, although at least one of the brackets may be in contact with the base of the rail, in particular in contact with the lower side surface of the base of the rail. At least one of the clamps may comprise a single clamping piece which is in contact with the lower and the upper side surface of the base of the rail while mounted to the rail.

Since the clamp produces the mounting force which fixes the device to the rail, it is easy to release the clamp from the rail and remove the clamp or to move the clamp to another position relative to the rail.

The upwardly extending section, or at least one of the upwardly extending sections, that is fastened to one of the brackets can be fastened at the same time to each of the pair of brackets that are fastened to the same clamp. However, it is also possible alternatively that the upwardly extending section is fastened to only one of the pair of brackets and that each of two separate upwardly extending sections is fastened to one of the brackets of the same pair of brackets. In the latter case, it is possible that the trackside module is fastened to both of the two separate upwardly extending sections.

Since the at least one upwardly extending section is fastened to the bracket or brackets, the mounting of the trackside module to the section or sections is easy and re-positioning of the section or sections relative to the clamp is possible without the need to loosen the fixation of the clamp on the rail. In particular, re-positioning is possible by loosening the fastening (fixation) of either at least one of the brackets on the clamp or of the at least one upwardly extending section on the bracket or brackets or of both.

On the other hand, it is also possible to loosen the fixation of the clamp on the rail while the at least one upwardly extending section is continuously fastened (i.e. fixed) to the bracket or brackets.

The brackets may be positioned perpendicularly to the longitudinal (e.g. Z-) axis of the rail. In addition or alternatively, the opposite first and second surfaces of the clamp may extend transverse to the longitudinal axis (e.g. Z-axis) of the rail, to which the device is to be mounted. The longitudinal axis of the rail extends in the direction of rail vehicle (e.g. train) movement, i.e. the travel direction.

Vertical (in particular vertically extending sections or, more generally speaking, upwardly extending) sections are fastened using (in particular threaded) fasteners to the outer side surfaces (the outer sides being the lateral sides if the device is mounted to a running rail) of the brackets. Trackside modules are (or can be) fastened to the upper ends of these vertical sections. Both movable clamps are connected with one another, e.g. by using fasteners, in particular threaded fasteners, that extend under the base of the rail, in particular in such a way that it is possible to demount the threaded fasteners from each of the clamps. At least one of the clamps that are clamped or are to be clamped on the base of the rail may have at least one non-adjustable lug.

According to an embodiment of the device, grooves may be formed in the specific mating surfaces of the items whose position in relation to one another is or can be changed by a user during operation. The mating surfaces are the surfaces where the clamps come into contact with the brackets. At least one set of these grooves is not or may be not parallel to the others.

Each of the movable clamps can be the basis for mounting the items that are designed for fastening a trackside module in the required position next to the head of a rail. The trackside modules can be located at any side of the head of a rail depending on the requirements for the trackside module that is to be fastened.

BRIEF DESCRIPTION OF THE DRAWINGS

An example of an embodiment of the invention is shown in the attached Figures.

DETAILED DESCRIPTION OF THE INVENTION

Figure 1:
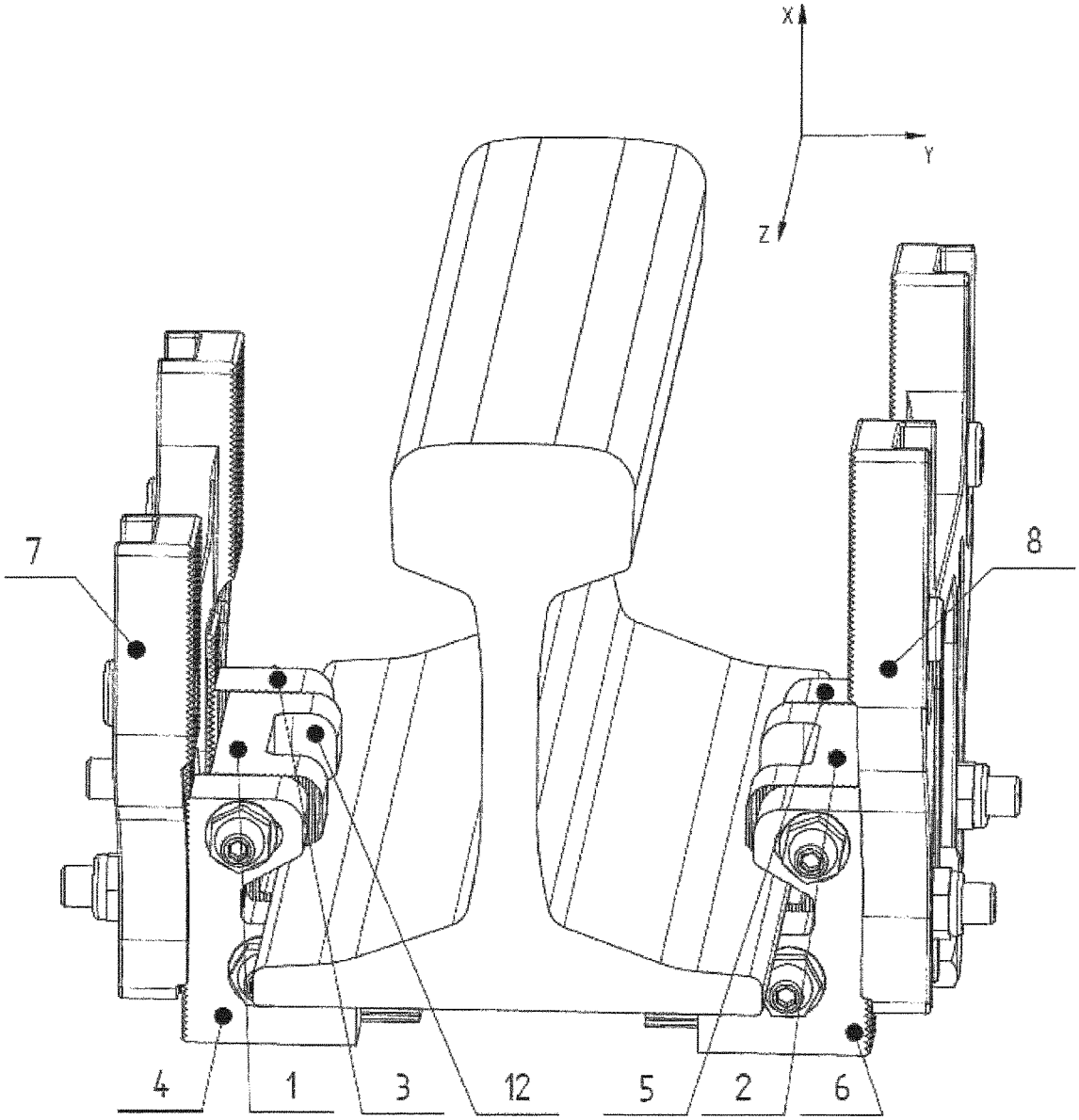
FIG. 1 shows an isometric view of a device for fastening trackside modules to a rail in their actual and/or required position of use on a rail (operating position) but without trackside modules.
Figure 2:
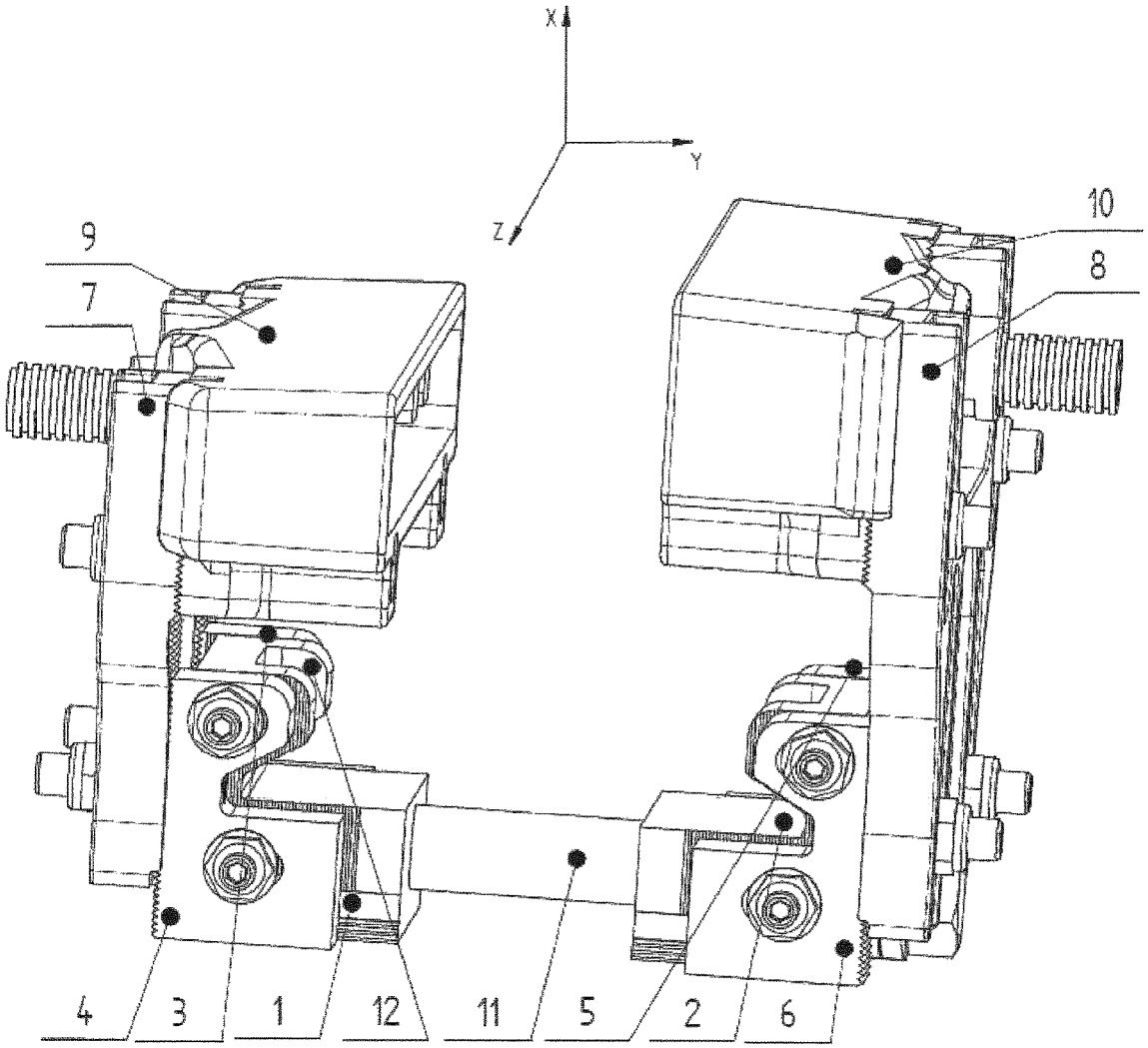
FIG. 2 shows the device with trackside modules fastened in its actual position of use (but without a rail being shown)
Figure 3:
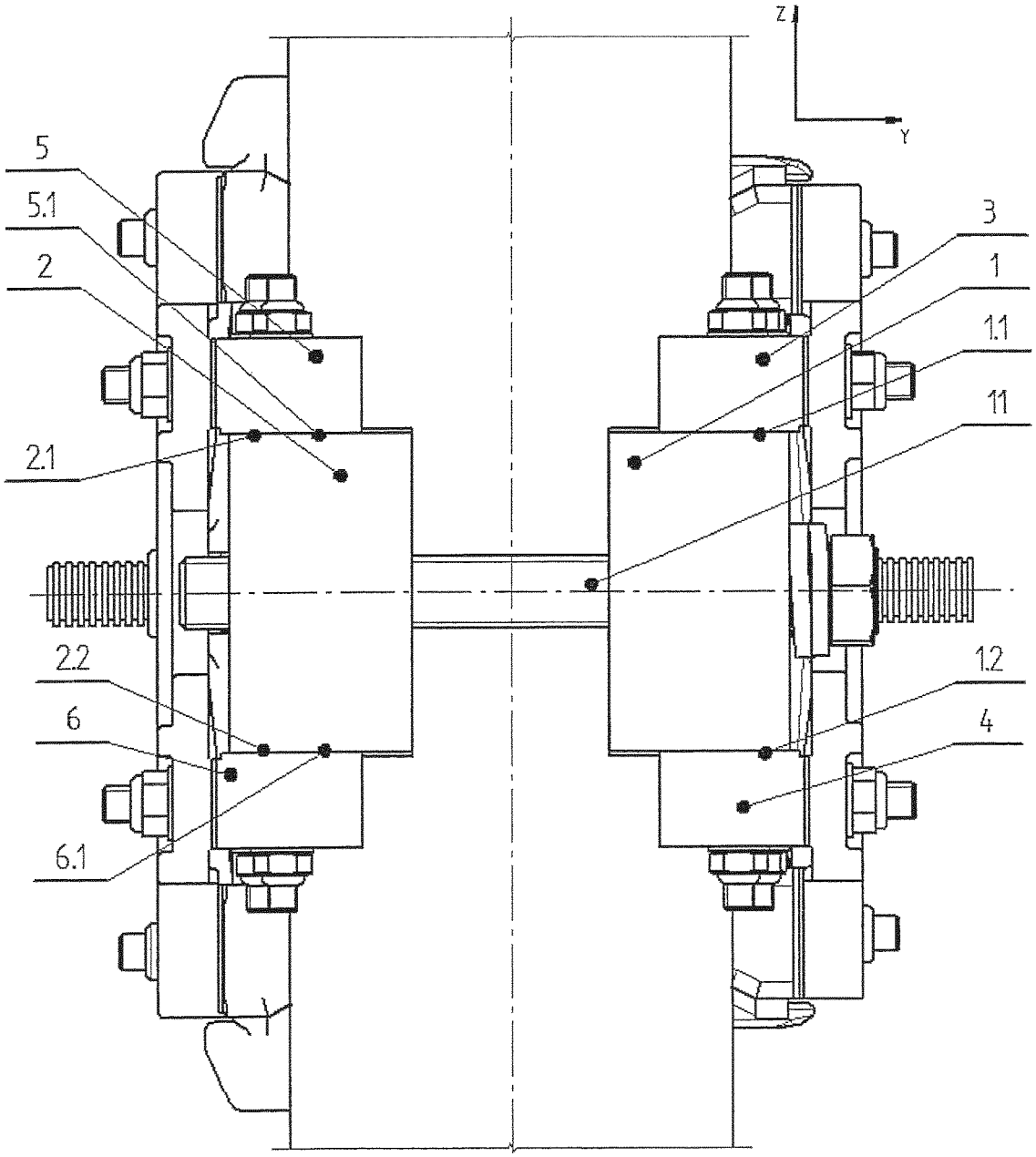
FIG. 3 shows the device in its actual position of use from the side of the base of a rail.

As it is shown in the Figures, the device for fastening trackside modules such as, e.g. wheel detector heads and/or current transformers, has two movable clamps 1, 2 with pairs of brackets 3, 4 and 5, 6 respectively which are fastened using threaded fasteners to the walls of the clamps that extend perpendicular to the Z axis of the rail (FIG. 2). Vertically extending sections 7 and 8 are fastened to the side outer surfaces of the brackets 3 and 4 and 5 and 6 respectively using threaded fasteners and the trackside modules 9 and 10 are fastened to the upper ends of the vertical sections. The clamps 1, 2 are connected with each other using threaded fasteners 11 that are led under the base of a rail in such a way that it is possible to demount the threaded fasteners from each of the clamps 1, 2. At least one of the clamps 1 or 2 that are clamped on the base of a rail has at least one non-adjustable lug 12.

There are grooves 5.1 and 6.1 made in the specific mating surfaces of the items that connect with one another and whose position in relation to one another can be changed by a user during operation, i.e. in the mating surfaces of the clamps 1, 2, and the brackets 3 and 4 as well as 5 and 6. At least one of these grooves or sets of grooves is not parallel to the others or other. The clamps 1, 2 have surfaces 1.1 and 1.2 and 2.1 and 2.2 which extend perpendicular to the rail axis and which enable mounting of the brackets 3, 4 and 5, 6 and sections 7, 8 on both sides of the head of a rail.

In the described device each of the clamps has a lug which together with the clamp forms an integral whole. Such a solution improves the resistance of the device to high vibration load and enables using higher forces that hold the clamps down to the base of a rail. Thanks to the use in the device consistent with the invention of lugs that are integrated with the clamps, as well as independently mounted brackets for a section to which a trackside module is fastened, it is possible to adjust the position and replace the trackside modules after the clamps have been installed on the rail which significantly facilitates the works related to installation and maintenance of the trackside modules.

Increased resistance of the device to vibrations, in particular vibrations that occur simultaneously along a number of axes, is achieved through the use of grooves that are not parallel to one another and are situated on the mating surfaces of the items that enable changing the position of a trackside module. Reduced complexity of the design of the device and thereby lower manufacturing cost has been achieved through standardizing the sections that are connected with the clamps. It is possible to use a set of sections with each of the clamps used.

The described design enables using typical fasteners in order to guarantee the pressure of the clamps on the base of a rail which contributes to reducing the device manufacturing and maintenance costs. Furthermore, the disclosed design allows for fastening the trackside modules on both sides of the rail at the same time and it is often required in respect of trackside modules forming a part of a rail traffic control system.

As far as the presented solution is concerned, it is required to use only one set of clamps for fastening of trackside modules on each side of a rail thereby resulting in lower cost of delivery of rail traffic control systems.

Example of an Embodiment

The movable clamps 1, 2 of the device which are clamped on the base of a rail are in the form of supports with brackets 3, 4, 5, 6 that are fastened to the side surfaces of supports. Clamping of the clamps 1, 2 on the base of a rail is possible thanks to the use of threaded fasteners 11 which are led via the clamps 1, 2 and under the base of the rail. The brackets 3, 4, 5 and 6 do not touch the base of the rail. The purpose of the brackets 3 and 4 is to hold the vertical section 7 together with a trackside module 9 in the required position. The change of position of brackets 3, 4 in parallel to the Y axis enables changing the position of the trackside module in parallel to Y axis.

The change of position of sections 7 in relation to brackets 3, 4 in parallel to X axis makes it possible to change the position of the trackside module 9 in parallel to X axis.

Figure 4:
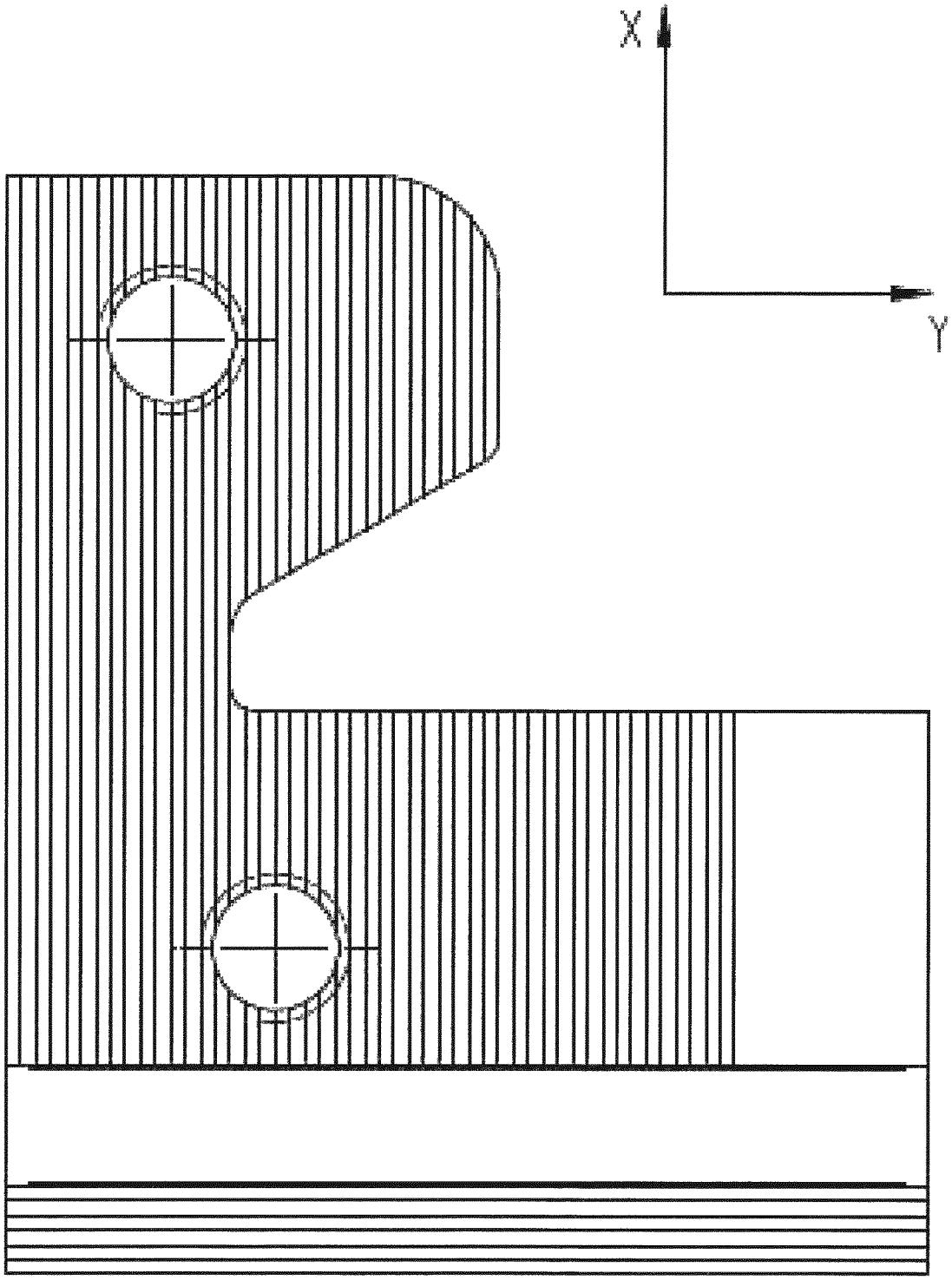
FIG. 4 shows an isometric view of non-parallel grooves that are made in the surface that connects the clamp with a pair of brackets that are mounted on it.

The purpose of brackets 5 and 6 is to hold the vertical section 8 together with a trackside module 10 in the required position. The change of position of brackets 5, 6 in parallel to the Y axis enables changing the position of the trackside module 10 in parallel to Y axis. The change of position of sections 8 in relation to brackets 5, 6 in parallel to X axis makes it possible to change the position of the trackside module 10 in parallel to X axis. The items which during the process of setting the operating position of trackside modules 9 and 10 need to change their position and to be re-fastened have grooves 5.1 and 6.1 on their mating surfaces, however some of the grooves are not parallel to the others as shown as an example in FIG. 4. The grooves 5.1 and 6.1 are made in the mating surfaces of clamps 1, 2 and brackets 3, 4 and 5, 6.

The invention claimed is:

1. A device for fastening trackside modules to a rail having a base and a head, the device comprising:

a first clamp and a second clamp configured to be clamped on the base of the rail with a mechanism that extends under the base of the rail, wherein at least one of the first clamp and the second clamp is movable, and a trackside module to be fastened next to the head of the rail, wherein a first pair of brackets fastened to side surfaces of the first clamp and a second pair of brackets fastened to side surfaces of the second clamp with first fasteners, wherein the first pair of brackets and the second pair of brackets extend transversely to a longitudinal axis of the rail, and at least one upwardly extending section fastened using second fasteners to at least one outer side surface of the first pair of brackets and the second pair of brackets, wherein at least one trackside module is configured to be fastened to an upper end region of the at least one upwardly extending section.

2. The device of claim 1, wherein the first clamp and the second clamp are connected with one another with threaded fasteners that extend under the base of a rail in such a manner to allow demounting of the threaded fasteners from each of the first clamp and the second clamp.

3. The device of claim 1, wherein at least one of the first clamp and the second clamp has at least one non-adjustable lug.

4. The device of claim 1, wherein one or more grooves are provided on mating surfaces where the first clamp comes into contact with the first pair of brackets and where the second clamp comes into contact with the second pair of brackets, and wherein at least one of the one or more grooves is not parallel to remaining one or more grooves.

5. The device of claim 1, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

6. The device of claim 2, wherein at least one of the first clamp and the second clamp has at least one non-adjustable lug.

7. The device of claim 2, wherein one or more grooves are provided on mating surfaces where the first clamp comes into contact with the first pair of brackets and where the second clamp comes into contact with the second pair of brackets, and wherein at least one of the one or more grooves is not parallel to remaining one or more grooves.

8. The device of claim 3, wherein one or more grooves are provided on mating surfaces where the first clamp comes into contact with the first pair of brackets and where the second clamp comes into contact with the second pair of brackets, and wherein at least one of the one or more grooves is not parallel to remaining one or more grooves.

9. The device of claim 6, wherein one or more grooves are provided on mating surfaces where the first clamp comes into contact with the first pair of brackets and where the second clamp comes into contact with the second pair of brackets, and wherein at least one of the one or more grooves is not parallel to remaining one or more grooves.

10. The device of claim 2, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

11. The device of claim 3, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

12. The device of claim 4, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

13. The device of claim 6, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

14. The device of claim 7, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

15. The device of claim 8, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

16. The device of claim 9, wherein each of the first clamp and the second clamp has opposite surfaces which extend transverse to the longitudinal axis of the rail, wherein a first of the first pair of brackets is fastened to a first surface of the first clamp and a second of the first pair of brackets is fastened to a second surface of the first clamp, and wherein a first of the second pair of brackets is fastened to a first surface of the second clamp and a second of the second pair of brackets is fastened to a second surface of the second clamp.

* * * * *